US005313889A

United States Patent [19]

Wilkerson et al.

[11] Patent Number: 5,313,889

[45] Date of Patent: May 24, 1994

[54] STABILIZATION BAND/RING ASSEMBLY FOR ALIGNING A PROJECTILE IN A GUN TUBE

[75] Inventors: Stephen A. Wilkerson, Street; Robert P. Kaste, North East; Bruce P. Burns, Churchville, all of Md.

[73] Assignee: The United States of America as represented by the Secretary of the Army, Washington, D.C.

[21] Appl. No.: 33

[22] Filed: Jan. 4, 1993

[51] Int. Cl.[5] ..... F42B 14/06

[52] U.S. Cl. ..... 102/439; 102/521; 102/524

[58] Field of Search ..... 102/439, 520–527

[56] References Cited

U.S. PATENT DOCUMENTS

| | | | |
|---|---|---|---|
| H405 | 1/1988 | Covey | 102/520 |
| 161,579 | 3/1875 | Van Gieson | 102/524 |
| 3,398,682 | 8/1968 | Abela | 102/439 |
| 3,981,246 | 9/1976 | Luther et al. | 102/521 |
| 4,284,008 | 8/1981 | Kirkendall et al. . | |
| 4,372,217 | 2/1983 | Kirkendall et al. . | |
| 4,587,905 | 5/1986 | Maki | 102/439 |
| 4,802,415 | 2/1989 | Clarke et al. | 102/521 |
| 4,901,645 | 2/1990 | Bisping et al. | 102/521 |
| 4,936,220 | 6/1990 | Burns et al. . | |

FOREIGN PATENT DOCUMENTS

| | | | |
|---|---|---|---|
| 48203 | 3/1982 | European Pat. Off. | 102/524 |
| 860735 | 1/1941 | France | 102/520 |
| 2241308 | 8/1991 | United Kingdom | 102/521 |

*Primary Examiner*—Harold J. Tudor

*Attorney, Agent, or Firm*—Saul Elbaum; Frank J. Dynda; Walter R. Baylor

[57] ABSTRACT

A double ramped, saboted, kinetic energy assembly automatically aligns a projectile in a gun tube. The assembly has an acceleration activated device consisting of a split centering ring causing alignment during the early phase of the shot motion of the projectile. The assembly also includes a series of small protrusions or a continuous expandable ring which forces and maintains the projectile into a straight aligned position during its traversal of the gun tube. The assembly may have either a smooth bore or a rifled bore gun tube. The disclosure also include a method related to the assembly.

4 Claims, 6 Drawing Sheets

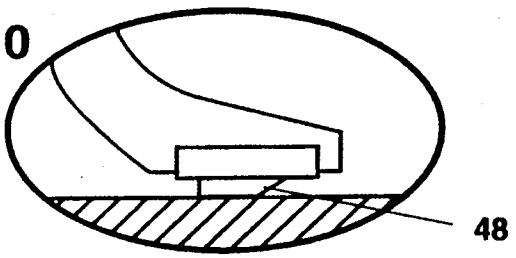
FIG. 10
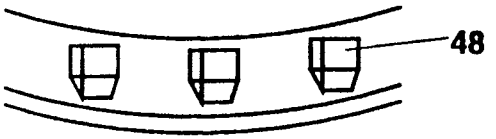
FIG. 11
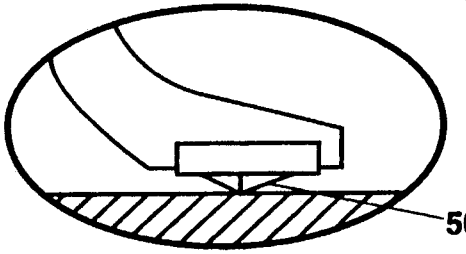
FIG. 12
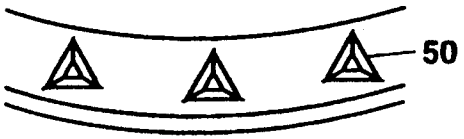
FIG. 13
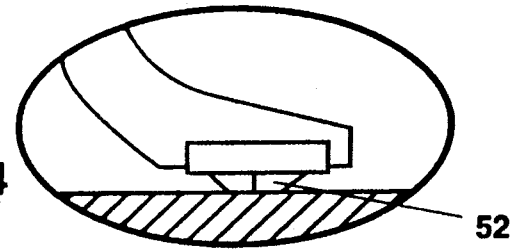
FIG. 14
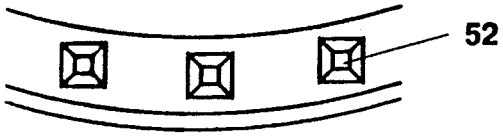
FIG. 15
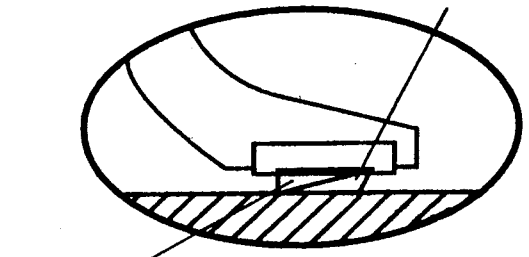
FIG. 16
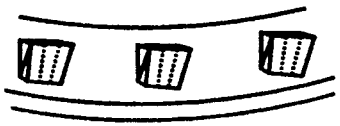
FIG. 18
FIG. 17

STABILIZATION BAND/RING ASSEMBLY FOR ALIGNING A PROJECTILE IN A GUN TUBE

RIGHTS OF THE GOVERNMENT

The invention described herein may be manufactured, used, and licensed by or for United States Governmental purposes without payment to us of any royalty thereon.

BACKGROUND OF THE INVENTION

1. Field of Invention

The present invention relates to a stabilization band and or a ring assembly for aligning a projectile in a gun tube. More specifically, the invention relates to a double ramped, saboted, kinetic energy projectile assembly which constitutes an improvement for modern sabot designs which automatically align an assembly in the gun tube and a method related thereto.

2. Description of the Prior Art

One of the most efficient sabot assembly presently used to launch a kinetic energy projectile from a high performance gun is one constructed using the double ramp principle. An example is U.S. Pat. No. 4,936,220 to Bruce P. Burns, et al. which discloses a double-ramp sabot having a rear ramp 17, a central bulkhead 22 with an obturator 26, and a forward ramp 19 with a forward scoop 18. Other examples are U.S. Pat. Nos. 4,284,008 and 4,372,217 to Richard D. Kirkendall, et al. which disclose a sabot having a double configuration and a centrally positioned obturator.

Typical assemblages include a shell casing, propellant/ignition system, and a projectile. The shell casing may be fixed to or be separate from the projectile. The projectile either as a discrete element or as part of an assembly with the shell casing is normally inserted into the gun barrel through a rear opening mechanism or breech. The breech is closed, the propellant charge ignited and the projectile is propelled via the expansion of combustive products through the gun barrel until it exits the barrel at its muzzle. In order to insert or chamber the projectile there must inherently be clearances between the projectile and the gun barrel. A stabilizating band device on the projectile commonly know as an obturator provides a mechanism to maintain the combustive gases at or behind the projectile by providing a seal between the projectile and the wall of the gun barrel. Other than this sealing mechanism there is no continuous radial connection or contact between the projectile and the gun barrel. In a double ramp sabot the front bore-rider fulfills two functions. Firstly, after the projectile's exit from the gun barrel, the front bore-rider aids in sabot discard. Secondly, and more importantly, in regard to the present invention the front bore-rider provides support to the projectile assembly while it is in the bore. The bore rider's surface which makes contact with the gun wall may be an integral part of the sabot or an insert. The contacting surface is commonly cylindrically shaped and of a lesser diameter than that of the inner most surface of the gun barrel. This feature allows the projectile assembly to be inserted into the gun and reduces any pressurization within the saddle region of the sabot if there is leakage around the obturator. However, the clearance necessary for the operation of this type of bore-rider has negative effects. The clearances allow the projectile assembly to be positioned in the gun tube noncencentrically and noncolinearly with respect to the center line axis of the gun barrel. The actual position of the projectile with respect to the gun tube depends upon many factors and accumulated tolerances, gun tube wear, erosion, thermal expansion, and manufacturing quality. The initial position and possible misalignment tends to affect the accuracy of the projectile's impact with a target.

3. Advantages over the Prior Art

The present invention prevents the projectile from being initially positioned out of alignment relative to the gun tube's center line. It also has the ability to prevent the projectile from becoming cocked, or misaligned, as it travels down the gun tube's length. Finally, the present invention allows propulsion gases, which may escape past the obturator, to move forward of the projectile assembly.

OBJECTS AND SUMMARY OF THE INVENTION

It is a primary object of the present invention to provide an assembly having a stabilization band and or a ring assembly for aligning the assembly colinearly and concentrically in a gun tube and a method related thereto.

It is another object of the invention to provide an improved assembly for existing double ramped, saboted, kinetic energy projectile apparatus which assembly will automatically align the projectile in the gun tube and a method related thereto.

It is an additional object of the invention to provide double ramped, saboted, kinetic projectile energy assembly having a stabilization band assembly for automatically aligning the projectile during its traversal of the gun tube and a method related thereto.

In summary, an assembly for use with double ramped, saboted, kinetic energy projectile apparatus aligns the projectile in the gun tube and a method related thereto. The assembly has a stabilization band and or ring for automatically aligning the projectile. The assembly is applicable to both smooth bore and rifled bore gun weapon systems.

BRIEF DESCRIPTION OF THE DRAWINGS

The foregoing and other objectives, aspects, uses and advantages of the present invention will be more fully appreciated as the same becomes better understood when considered in connection with the following accompanying drawings, in which:

FIGS. 10 and 11 show enlarged views of protrusions having a wedge configuration.

FIGS. 12 and 13 show enlarged views of protrusions having a triangular configuration.

FIGS. 14 and 15 show enlarged views of protrusions having a pyramidal configuration.

FIGS. 16, 17 and 18 show enlarged views of protrusions having an interlocking wedge configuration.

DESCRIPTION OF THE PREFERRED EMBODIMENT

Figure 1:
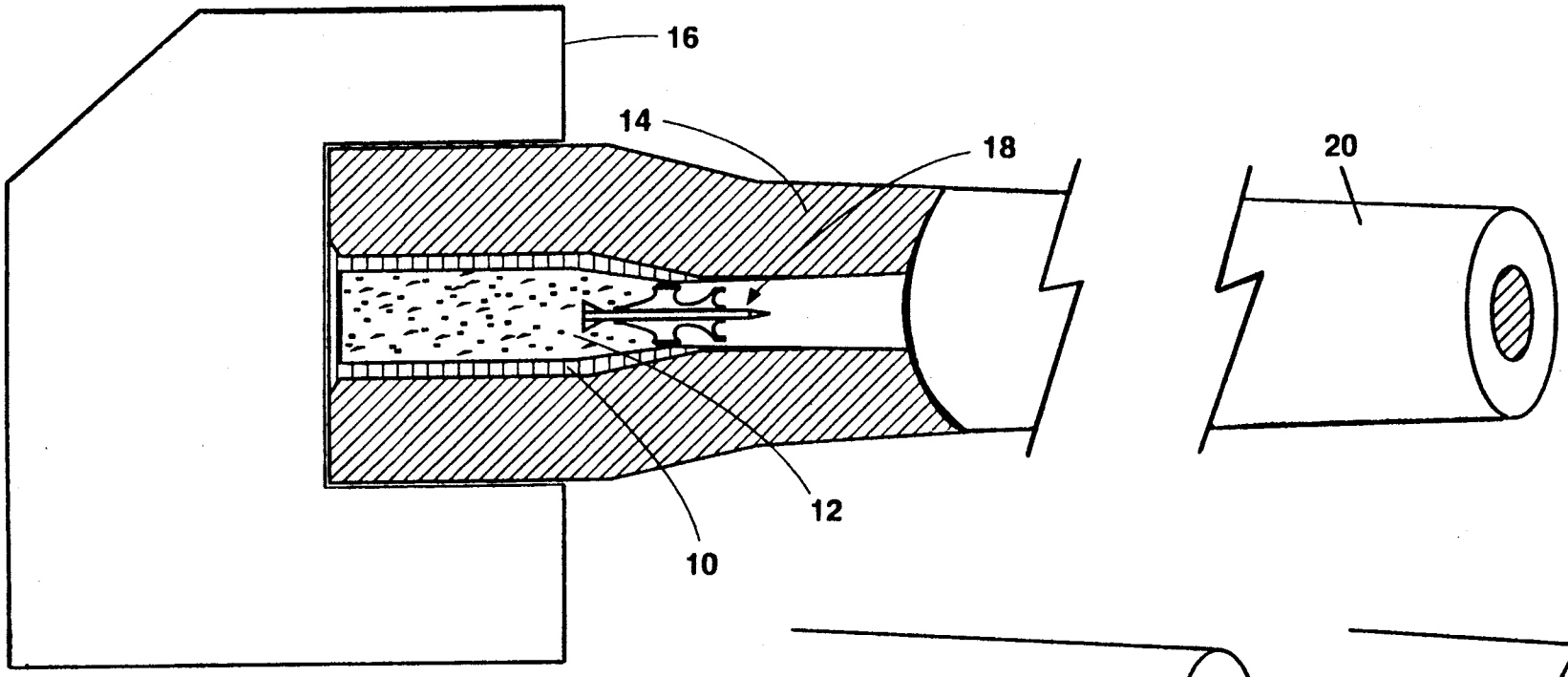
FIG. 1 shows an exploded cross sectional side view of a gun tubular muzzle, breech, and cartridge assembly having a shell casing, propellant, and projectile.

Referring to the drawings, like reference numerals represent identical or corresponding parts throughout the several views.

Figure 2:
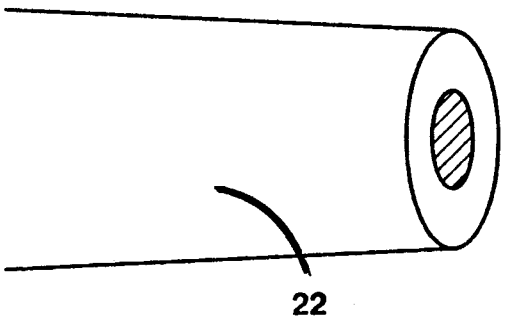
FIG. 2 shows a perspective view of the muzzle having a rifled bore gun barrel.
Figure 3:
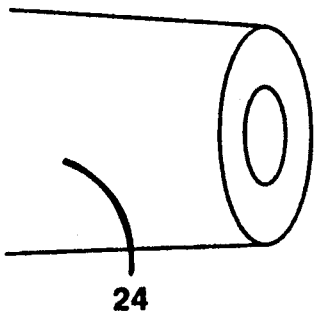
FIG. 3 shows a perspective view of the muzzle having a smooth bore gun barrel.

FIG. 1 discloses a shell casing 10 and a propellant charge 12 inserted in a gun tube 14. A breech 16 has a rear closure for the gun tube 14 through which a projectile assembly 18 will pass exiting from gun muzzle 20. The gun tube 14 may have a rifled bore 22 or a smooth bore 24 as shown in FIGS. 2 and 3. The rifled bore 22 has a series of spiraling grooves and lands which force the projectile 18 to rotate as it traverses the gun tube 14.

Figure 4:
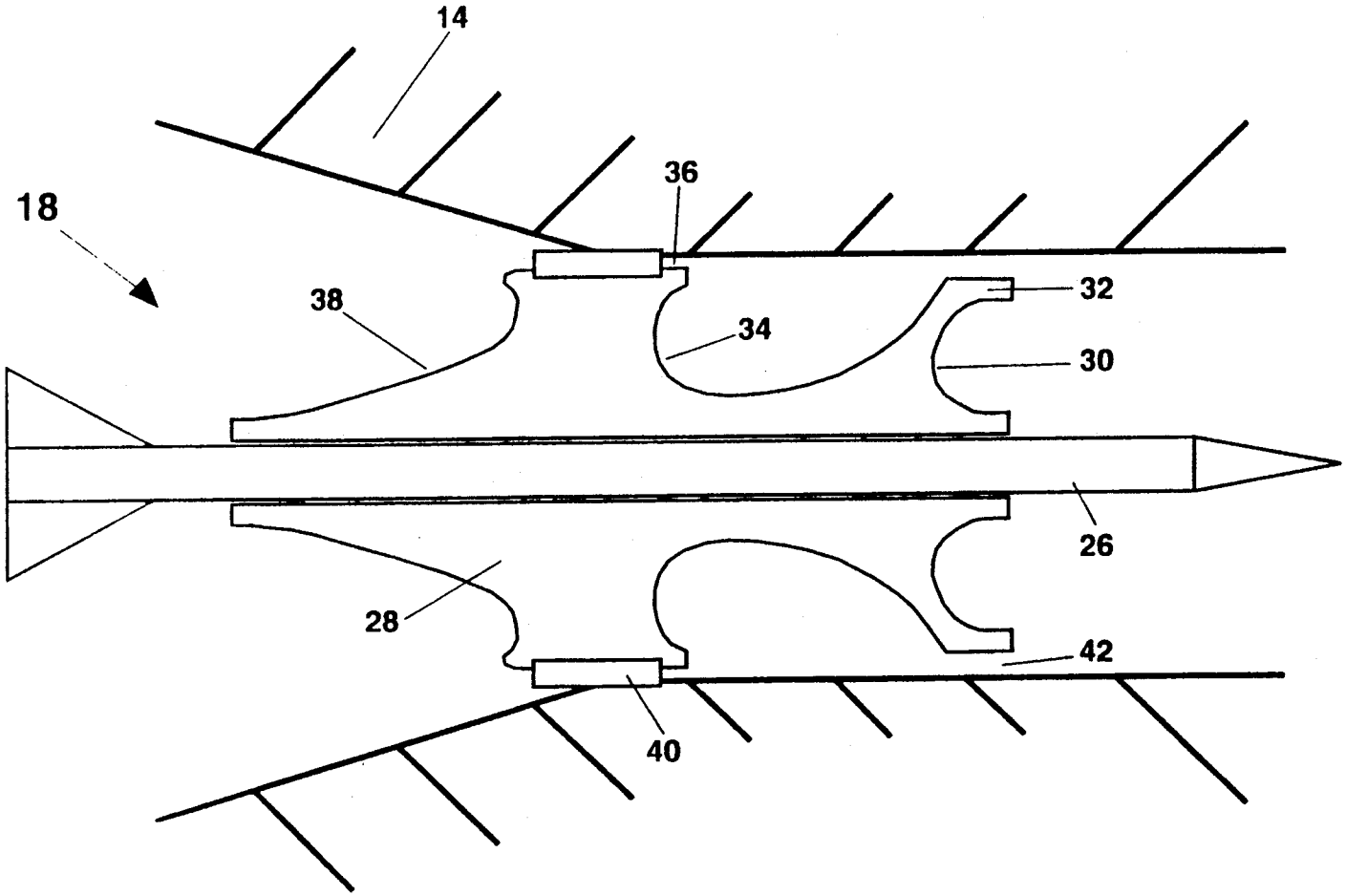
FIG. 4 shows a cross sectional side view of a sabot, a sub- projectile, and an obturator assembly with the gun barrel in an initial or chambered position.

FIG. 4 shows the projectile assembly 18 and its components in the gun tube 14. A sub-projectile 26 which is contained by a double ramped sabot 28 comprises a front ramp section or air scoop 30, a front bore-rider portion 32, an intermediate saddle section 34, a rear bore-rider portion 36, and a rear ramp section 38.

A rotating band member or an obturator 40 is mounted on the rear bore-rider 36. The obturator 40 provides a seal between the sabot 28 and the gun tube 14 and allows the combustive products of the propellant charge 12 to propel the projectile 18 in a straight aligned path within the gun tube 14. The obturator 40 provides a slidable contact with the projectile 18 within the gun tube 14 and controls the path and rotation of the projectile 18 via its engagement of either the rifled bore 22 or the smooth bore 24.

Figure 5:
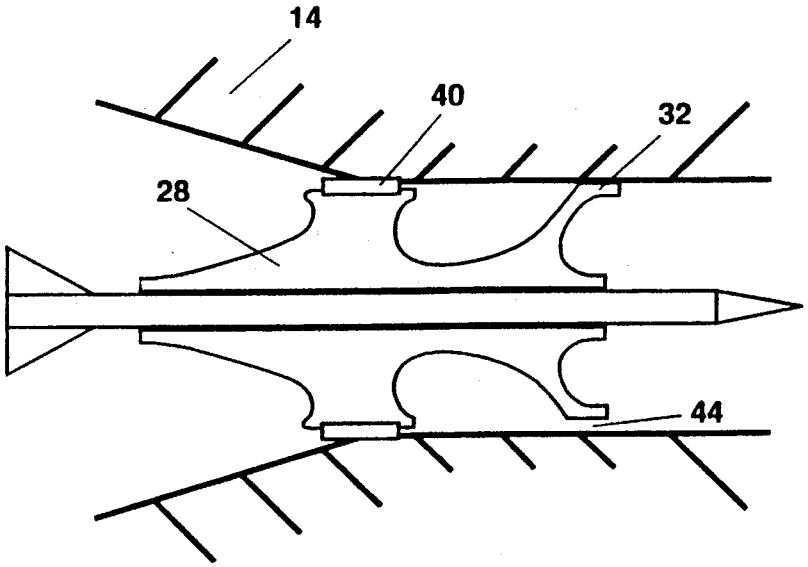
FIG. 5 shows a cross sectional side view of the projectile with its forward end positioned above the centerline axis of the gun barrel.
Figure 6:
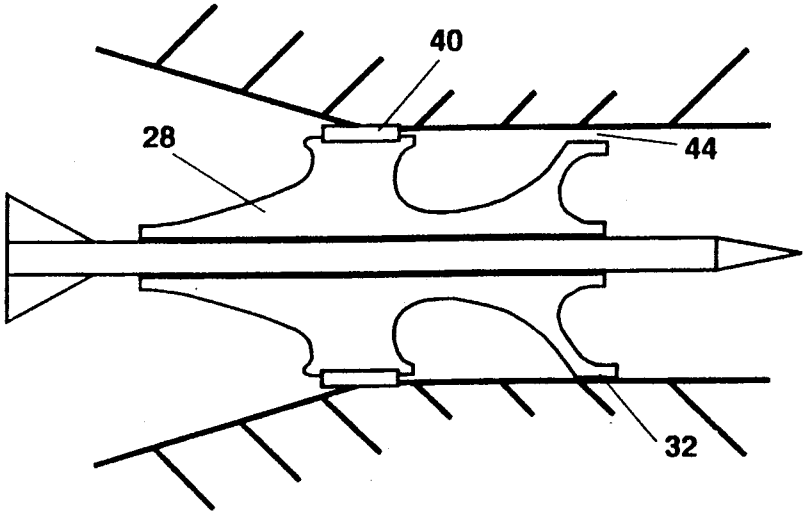
FIG. 6 shows a cross sectional side view of the projectile with its forward end positioned below the centerline axis of the gun barrel.

The front bore-rider portion 32 may be an integral extended part of the front ramp section 30 and can be manufactured from a single material or from several materials. The front bore-rider 32 has radial clearance 42 with the gun tube 14. The clearance 42 allows the projectile 18 to be inserted into the gun tube 14. However, the radial clearance 42 may be nonconcentric with the gun bore 22 or 24, permitting the projectile 18 to be noncolinear and nonconcentric with the gun tube 14 as shown in FIGS. 5 and 6 where the clearance area or spacing between the front bore-rider 32 and the bore 22 or 24 is an additional or nonconcentric clearance 44. As a general rule the front bore-rider 32 has more clearance spacing within the gun tube 14 than the rear bore-rider 36. In FIG. 5 the sabot 28 is seen in a tilt up position with respect to the obturator 40. That is, the projectile 18 with its noncolinear, nonconcentric position is chambered with its forward end positioned above the centerline axis of the gun tube 14. In FIG. 6 the sabot 28 is seen in a tilt down position with respect to the obturator 40. That is, the projectile 18 with its noncolinear, nonconcentric position is chambered with its forward end position below the centerline axis of the gun tube 14. Thus, the additional clearance 44 can allow the sub-projectile 26 to seat slightly out of alignment.

Figure 7:
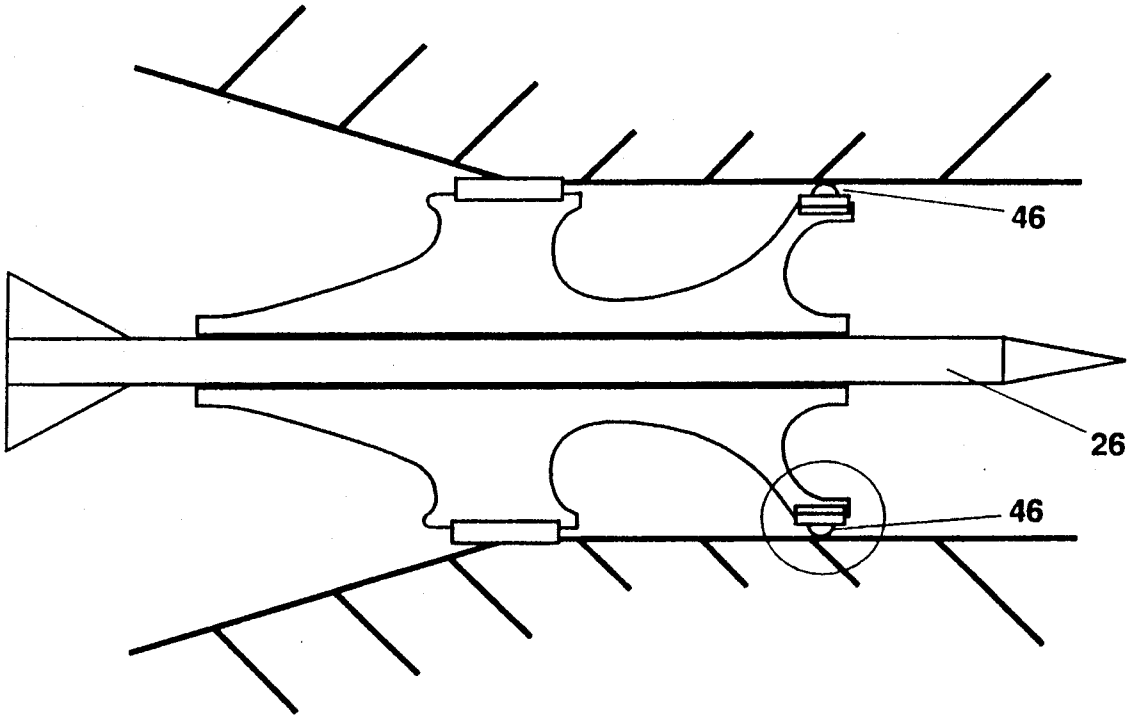
FIG. 7 shows a cross sectional side view of ellipsoidal shaped protrusions on front bore-rider of the assembly.
Figure 8:
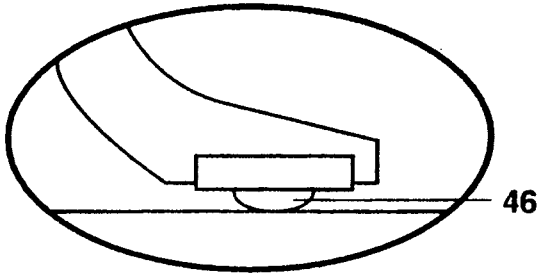
FIGS. 8 and 9 show enlarged views of the ellipsoidal shaped protrusions.
Figure 9:
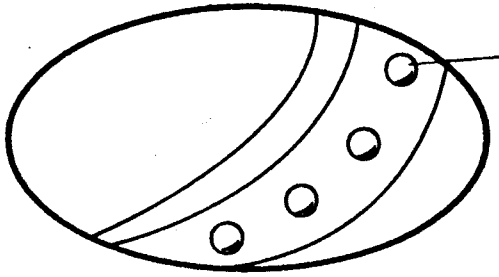

The clearance spacing 44 can be taken up or filled by incorporating a plurality of upwardly projecting protuberances or protrusion members mounted in circumferential manner on the front bore-rider 32. In FIGS. 7 to 9 protrusion members 46 are shaped as bubbles or ellipsoidal. The protrusions 46 assist the projectile 20 to seat in a more satisfactory operational position in the gun tube 14 and maintain interface contact between the front bore-rider 36 and the gun bore 22 or 24. The protrusions 46 are spaced apart from each other and are supported along the circumferential edge of the sabot 18. The protrusions 46 provide pathways for any combustive products of the propellant charge 12 which may have leaked pass the obturator 40 to pass by the front bore-rider 36 thereby preventing pressurization of the saddle region 34. The protrusions 46 can be made from a number of materials; for example, the material of the protrusions 46 may be polypropylene. The protrusions 46 should be sufficiently compliant as to allow the insertion of the projectile 18 while maintaining adequate contact forces between the projectile 18 and the gun bore 22 or 24 to permit concentric self alignment of the projectile 18 with the gun tube 14.

FIGS. 10 to 18 show additional configurations for the protrusion members. However, the protrusion members are not considered to be limited to any of the particular configurations disclosed herein. FIGS. 10 and 11 disclose wedge shaped members 48; FIGS. 12 and 13, triangular shaped members 50; and FIGS. 14 and 15, pyramidal shaped members 52. In FIGS. 16, 17 and 18 the protrusion members are shown as a set of interlocking wedges elements; that is, a forward (top) wedge element 54*a* and a rearward (bottom) wedge element 54*b*. The forward wedge element 54*a* is fixedly mounted and the rearward wedge 54*b* is slidably mounted and is allowed to slide upwardly. The wedges 54*a*, 54*b* provide the additional advantage of maintaining the alignment of the projectile 18 throughout its travel along the gun tube 14. The shape of the interlocking wedges 54*a*, 54*b* constantly forces more material of the forward wedge 54*a* up the ramp of the rearward wedge 54*b* to maintain a slidable contact between the projectile 18 and the gun bore 22 or 24 although material of the forward wedge 54*a*, which is in contact with the gun tube 14, may have been worn away by friction.

Figure 19:
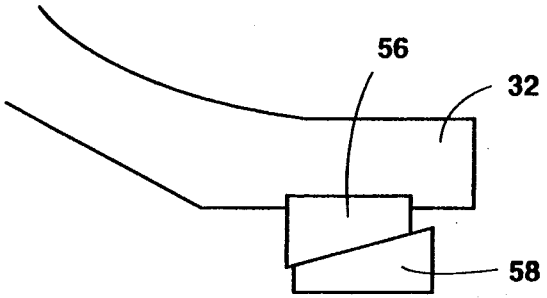
FIG. 19 shows a perspective view of a split centering ring in its initial position on the front bore-rider.
Figure 20:
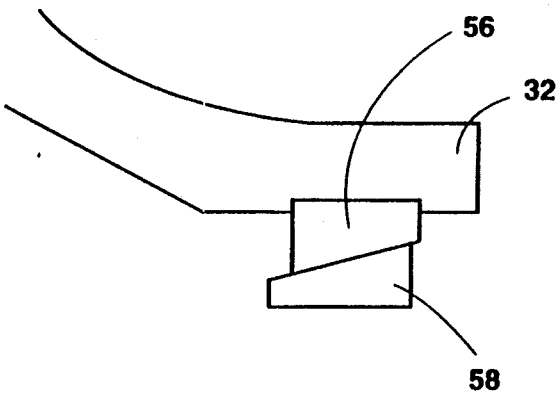
FIG. 20 shows another view of the split centering ring in its final position.

In lieu of or in addition to the protrusion members of FIGS. 7 to 17, the clearance spacing 44 can be filled, as seen in FIGS. 19 and 20, by a split centering ring member 56 which may be an integral part of the front bore-rider portion 32 or a separate insert thereto. The axisymmetric inclined plane 58 is slidably mounted on the ring 56. As the propellant combustive process is initiated, the projectile 18 begins to accelerate and to move within the bore 22 or 24 of the gun tube 14. The split centering ring 58 is driven to the rear by its own inertia to a final position as seen in FIG. 20, causing it to expand radially against the smooth surface of the bore 24 or the grooves of the rifled bore 22, thereby causing this part of the projectile 18 to be centered. The ring 56 is made of steel which has a hard, relatively dense characteristic which will substantially prevent engraving damage to the gun tube 14 during the frictional movement of the projectile 18. The axisymmetric inclined plane 58 may be constructed of a suitable material such as nylon to optimize projectile vibration and or damping characteristics.

Figure 21:
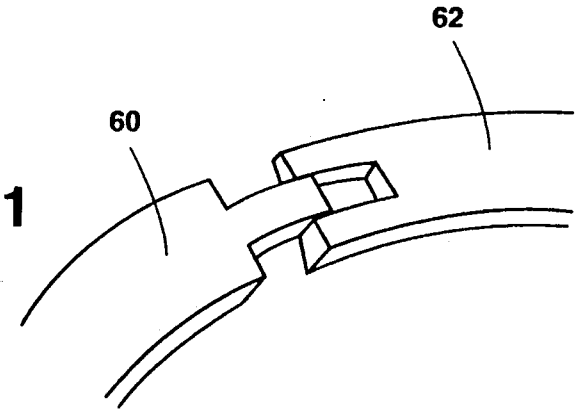
FIG. 21 shows a perspective view of a dovetail connection for the ring.
Figure 22:
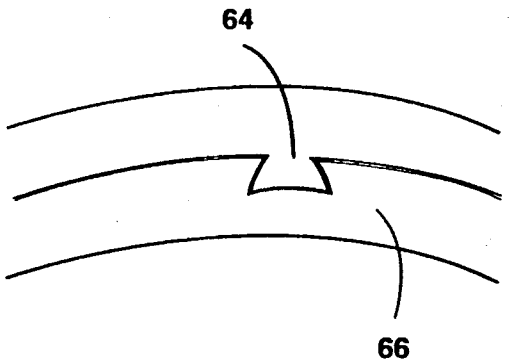
FIG. 22 shows a perspective view of another connection for the ring.

In order to ensure axial alignment of one portion of the split ring 56 with other protrusions and to provide some form of circumferential continuity, the parts can be interlocked with appropriately number of shaped mortises, such as dove tail male and female keyway members 60, 62, as shown in FIG. 21. The male keyway 60 interfaces with matching female keyway 62 which allows the split ring 56 to expand radially and to be released from the projectile 18 upon exit from the gun tube 14. Thus, the female keyway 62 serves as a receptor for matching and sliding male keyway 60, shaped so as to preclude unwanted disassembly, yet releaseable during sabot discard. Axially-oriented, similarly interlocking bayonet members 64, 66, as shown in FIG. 22, may be incorporated to retain proper circumferential alignment and allow for axial motion.

Obviously numerous modifications and variations of the present invention are possible in light of the above disclosure. The protrusions can be located in other regions of the projectile 18 such as the rear bore-rider section 36. This would alter the positioning of the projectile 18 in the gun tube 14 and would modify the interfaces of the projectile 18 with the gun bore 22 or 24 as to affect the vibrational response of the projectile 18 to its propulsion through the gun bore 14. The control of the vibrational response of the projectile 18 through these interface protrusions could be used to improve the efficiency and accuracy of the sub-projectile 26. The split centering ring 56 may be mounted on the rear bore-rider portion 36 in the vicinity of the obturator 40 and would likewise center the mid or rear section of the projectile 18. Thus, it is to understood that the present invention can be practiced otherwise than as specifically described herein and still will be within the spirit and scope of the appended claims.

What is claimed is:

1. Apparatus for automatically aligning and seating a projectile concentrically in a gun tube, comprising in combination:

the gun tube having a bore, a shell casing for the gun tube, a sabot mounted on the shell casing and having a double ramp assembly, the assembly having a front ramp section with a front bore-rider portion and a rear ramp section with a rear bore-rider portion, the front bore-rider portion having more clearance spacing within the gun tube than the rear bore-rider portion, this additional clearance spacing permitting the projectile within the gun tube to seat slightly out of alignment, and this additional clearance spacing being taken up by incorporating an interface means on the front bore-rider portion for maintaining the alignment of the projectile as it travels down the gun tube, wherein the interface means on the front bore-rider portion comprises a series of radially and outwardly projecting ellipsoidal shaped protrusion members.

2. Apparatus as defined in claim 1 wherein the gun bore is a smooth bore.

3. Apparatus as defined in claim 1 wherein the gun bore is a rifled bore.

4. A method for automatically aligning a projectile in a weapon gun tube prior to and during the combustive stage within a double ramped, saboted assembly, comprising in combination the following steps:

inserting the projectile into a rear opening of the gun tube, operationally subjecting the projectile to a stabilizing band member mounted on a rear ramp section of the double ramped, saboted assembly for seating and aligning the projectile prior to combustion of a propellant charge in the gun tube, and operationally subjecting the projectile to an interface means mounted on the double ramped, saboted assembly for forcing and maintaining the projectile in a straight aligned path during its passage through the gun tube, wherein said interface means comprises a front bore-rider portion further comprising a series of ellipsoidal protrusion members compliantly, and supportively attached to the front bore-rider portion of said saboted assembly whereby spaces between said protrusion members provide pathways for any combustive products of a propellant charge which may have leaked pass said stabilizing band member to pass by the front bore-rider portion thereby preventing pressurization of a saddle region between said front bore-rider portion and said stabilizing band member.

* * * * *